US008824906B2

(12) United States Patent
Ishihara et al.

(10) Patent No.: US 8,824,906 B2
(45) Date of Patent: Sep. 2, 2014

(54) IMAGE FORMING APPARATUS CAPABLE OF PRINTING LONG SHEETS

(71) Applicant: KYOCERA Document Solutions Inc., Osaka (JP)

(72) Inventors: Chikara Ishihara, Osaka (JP); Masashi Fujishima, Osaka (JP)

(73) Assignee: Kyocera Document Solutions Inc. (JP)

( * ) Notice: Subject to any disclaimer, the term of this patent is extended or adjusted under 35 U.S.C. 154(b) by 49 days.

(21) Appl. No.: 13/790,308

(22) Filed: Mar. 8, 2013

(65) Prior Publication Data

US 2013/0243454 A1 Sep. 19, 2013

(30) Foreign Application Priority Data

Mar. 15, 2012 (JP) ..... 2012-058274

(51) Int. Cl.
*G03G 15/00* (2006.01)
*G03G 15/08* (2006.01)

(52) U.S. Cl.
CPC ..... *G03G 15/50259* (2013.01); *G03G 15/0808* (2013.01); *G03G 15/757* (2013.01); *G03G 2215/00734* (2013.01); *G03G 15/0806* (2013.01); *G03G 15/5008* (2013.01); *G03G 15/6594* (2013.01)
USPC ..... 399/45; 399/46; 399/53

(58) Field of Classification Search
CPC ..... G03G 15/5008; G03G 15/5029; G03G 2215/00734; G03G 2215/00751
USPC ..... 399/45, 46, 53
See application file for complete search history.

(56) References Cited

U.S. PATENT DOCUMENTS

| | | | | |
|---|---|---|---|---|
| 6,487,385 | B2 * | 11/2002 | Yoshii et al. | 399/239 |
| 6,696,213 | B2 * | 2/2004 | Yamaguchi et al. | 430/122.2 |
| 2002/0150413 | A1 | 10/2002 | Akita et al. | |
| 2005/0191073 | A1 * | 9/2005 | Kawamura et al. | 399/55 |
| 2006/0127133 | A1 * | 6/2006 | Suzuki | 399/167 |
| 2007/0047985 | A1 * | 3/2007 | Kamijo et al. | 399/45 |
| 2007/0223951 | A1 | 9/2007 | Kietzman | |

FOREIGN PATENT DOCUMENTS

| | | |
|---|---|---|
| JP | 2005-55837 | 3/2005 |
| JP | 2005-55840 | 3/2005 |
| JP | 2005-107407 | 4/2005 |

* cited by examiner

*Primary Examiner* — Benjamin Schmitt
(74) *Attorney, Agent, or Firm* — Gerald E. Hespos; Michael J. Porco; Matthew T. Hespos

(57) ABSTRACT

In the case of a standard sized sheet, a first controller sets a linear velocity D of an image bearing member at a first velocity and sets a linear velocity S of a toner bearing member so that S/D, which is a ratio of the linear velocity S to the linear velocity D, has a first value and a second controller sets the thickness of the toner layer carried on the toner bearing member at a first layer thickness. In the case of a long sheet, the first controller sets the linear velocity D at a second velocity slower than the first velocity and sets the linear velocity S so that the S/D has a second value larger than the first value and the second controller sets the thickness of the toner layer at a second layer thickness smaller than the first layer thickness.

4 Claims, 8 Drawing Sheets

IMAGE FORMING APPARATUS CAPABLE OF PRINTING LONG SHEETS

This application is based on Japanese Patent Application Serial No. 2012-58274 filed with the Japan Patent Office on Mar. 15, 2012, the contents of which are hereby incorporated by reference.

BACKGROUND

The present disclosure relates to an image forming apparatus for transferring a toner image to a sheet and particularly to an image forming apparatus capable of transferring a toner image to a long sheet larger than A3 size.

An image forming apparatus such as a copier, a printer or a facsimile machine utilizing an electrophotographic method forms a toner image on an image bearing member (e.g. photoconductive drum or transfer belt) by supplying a developer to an electrostatic latent image formed on the image bearing member and developing the electrostatic latent image. A touch-down developing method using a two-component developer containing nonmagnetic toner particles and magnetic carrier particles is known as one of developing methods. In this method, a two-component developer layer (so-called magnetic brush layer) is carried on a magnetic roller, the toner particles are received from the magnetic brush layer and a toner layer is carried on a developing roller, and the toner particles are supplied from the toner layer to the image bearing member, thereby visualizing the electrostatic latent image.

In a developing device adopting the touch-down development method, it is known to perform a stripping operation of forcibly collecting toner particles once carried on the developing roller by the magnetic brush layer on the magnetic roller by changing a bias applied to the developing roller every time one sheet is printed. By performing this stripping operation, it is possible to prevent the deterioration of the toner particles associated with the stay of the toner particles on the developing roller for a long time.

Some of image forming apparatuses can print not only standard sized sheets such as A4 and A3 sheets, but also long sheets, the size of which in a sub scanning direction is 1000 mm or longer. Since a developing time per sheet becomes longer in printing such long sheets, a toner layer is carried on a developing roller for a longer time. Thus, even if the stripping operation is performed between sheets, the toner particles on the developing roller may be excessively charged during a transfer process for one long sheet and a transfer failure (image defect) such as a solid image blank area may occur.

An object of the present disclosure is to prevent the occurrence of an image defect associated with the deterioration of toner particles in an image forming apparatus capable of transferring a toner image to a long sheet.

SUMMARY

An image forming apparatus according to one aspect of the present disclosure includes an image bearing member, a developer bearing member, a toner bearing member, a driving mechanism, a sheet size discriminator, a first controller and a second controller.

The image bearing member bears an electrostatic latent image and a toner image. The developer bearing member bears a developer layer containing toner particles and carrier particles while rotating in a predetermined direction. The toner bearing member receives the toner particles from the developer layer and carries a toner layer while rotating in contact with the developer layer and supplies the toner particles of the toner layer to the image bearing member to develop the electrostatic latent image. The driving mechanism drives and rotates the image bearing member, the developer bearing member and the toner bearing member. The sheet size discriminator discriminates whether a sheet to which the toner image is to be transferred is a standard sized sheet or a long sheet, the size of which in a sub scanning direction is longer than the standard sized sheet. The first controller controls a linear velocity D of the image bearing member, a linear velocity M of the developer bearing member and a linear velocity S of the toner bearing member by controlling the driving mechanism. The second controller controls the thickness of the toner layer carried on the toner bearing member.

When the sheet size discriminator discriminates that the sheet to which the toner image is to be transferred is the standard sized sheet, the first controller sets the linear velocity D at a predetermined first velocity and sets the linear velocity S so that S/D, which is a ratio of the linear velocity S to the linear velocity D, has a predetermined first value. The second controller sets the thickness of the toner layer carried on the toner bearing member at a predetermined first layer thickness.

When the sheet size discriminator discriminates that the sheet to which the toner image is to be transferred is the long sheet, the first controller sets the linear velocity D at a second velocity slower than the first velocity and sets the linear velocity S so that the S/D has a second value larger than the first value. The second controller sets the thickness of the toner layer at a second layer thickness smaller than the first layer thickness.

These and other objects, features and advantages of the present disclosure will become more apparent upon reading the following detailed description along with the accompanying drawings.

DETAILED DESCRIPTION

Figure 1:
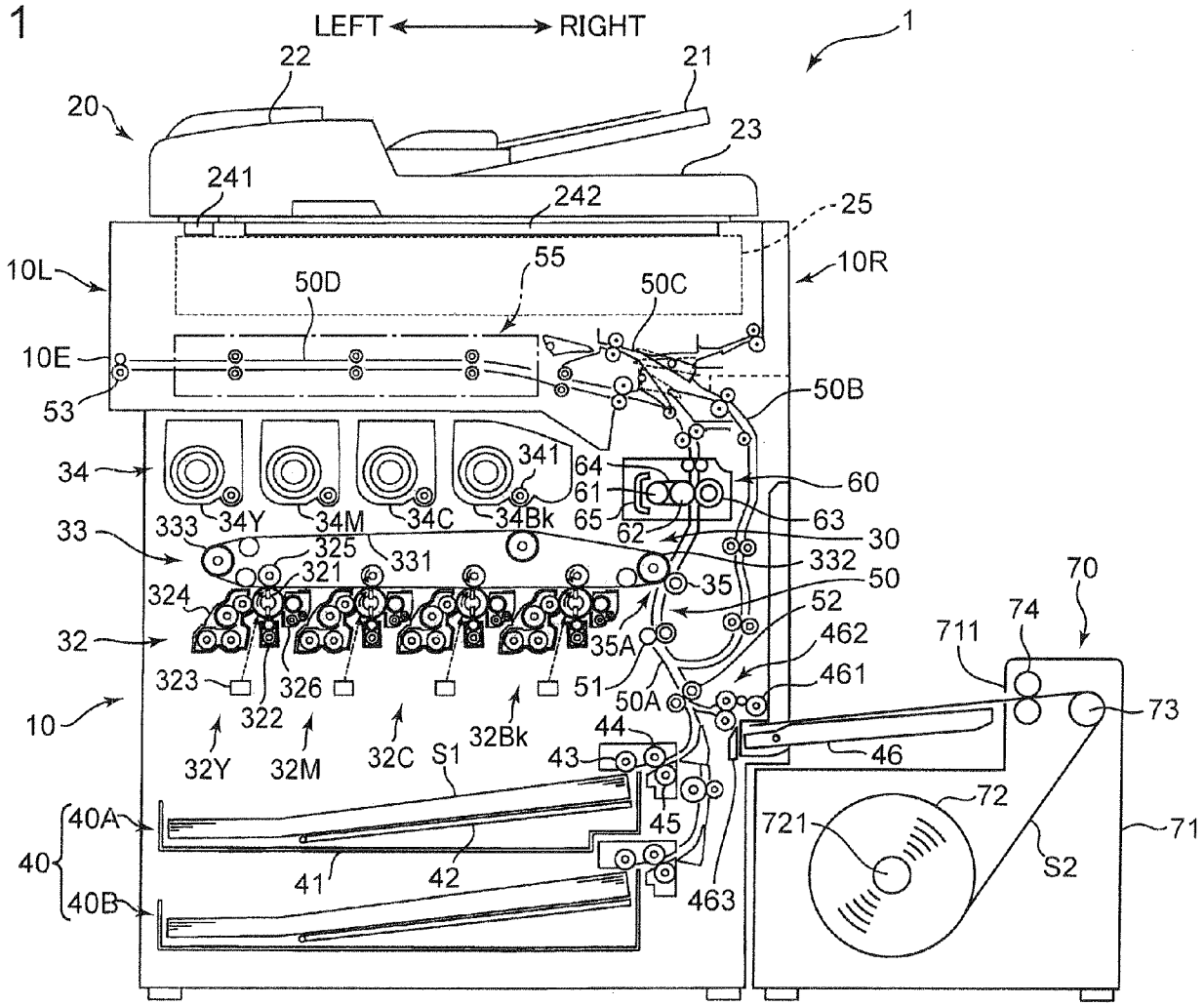
FIG. 1 is a sectional view showing one embodiment of an image forming apparatus according to the present disclosure.

Hereinafter, an embodiment of the present disclosure is described in detail based on the drawings. FIG. 1 is a sectional view showing the internal structure of an image forming apparatus 1 according to one embodiment of the present disclosure. Although a complex machine with a printer function and a copier function is illustrated as the image forming apparatus 1 here, the image forming apparatus may also be a printer, a copier or a facsimile machine.

The image forming apparatus 1 includes an apparatus main body 10 having a substantially rectangular parallelepipedic housing structure, an automatic document feeder 20 arranged on the apparatus main body 10, and an external cassette 70 attached to a lower part of a right side surface 10R of the apparatus main body 10 and adapted to feed long sheets. In the apparatus main body 10 are housed a reading unit 25 for optically reading a document image to be copied, an image forming station 30 for forming a toner image on a sheet, a fixing unit 60 for fixing the toner image to the sheet, a sheet feeder unit 40 for storing standard sized sheets to be conveyed to the image forming station 30, a conveyance path 50 for conveying a standard sized sheet or a long sheet from the sheet feeder unit 40 or the external cassette 70 to a sheet discharge opening 10E via the image forming station 30 and the fixing unit 60, and a conveying unit 55 including a sheet conveyance path constituting a part of the conveyance path 50 inside.

The automatic document feeder (ADF) 20 is rotatably mounted on the upper surface of the apparatus main body 10. The ADF 20 automatically feeds a document sheet to be copied toward a predetermined document reading position (position where a first contact glass 241 is mounted) in the apparatus main body 10. On the other hand, when a user manually places a document sheet on a predetermined document reading position (position where a second contact glass 242 is arranged), the ADF 20 is opened upwardly. The ADF 20 includes a document tray 21 on which document sheets are to be placed, a document conveying unit 22 for conveying a document sheet via an automatic document reading position, and a document discharge tray 23 to which the document sheet after reading is to be discharged.

The reading unit 25 optically reads an image of a document sheet via the first contact glass 241 for reading a document sheet automatically fed from the ADF 20 on the upper surface of the apparatus main body 10 or the second contact glass 242 for reading a manually placed document sheet. A scanning mechanism including a light source, a moving carriage, a reflecting mirror and the like and an image pickup device (not shown) are housed in the reading unit 25. The scanning mechanism irradiates a document sheet with light and introduces its reflected light to the image pickup device. The image pickup device photoelectrically converts the reflected light into an analog electrical signal. The analog electrical signal is input to the image forming station 30 after being converted into a digital electrical signal in an A/D conversion circuit.

The image forming station 30 performs a process of generating a full-color toner image and transferring it onto a sheet. The image forming station 30 includes image forming units 32 composed of four tandemly arranged units 32Y, 32M, 32C and 32Bk for forming toner images of yellow (Y), magenta (M), cyan (C) and black (Bk), an intermediate transfer unit 33 arranged above and adjacent to the image forming units 32 and a toner supply unit 34 arranged above the intermediate transfer unit 33.

Each of the image forming units 32Y, 32M, 32C and 32Bk includes a photoconductive drum 321 (image bearing member), and a charger 322, an exposure device 323, a developing device 324, a primary transfer roller 325 and a cleaning device 326 arranged around this photoconductive drum 321.

The photoconductive drum 321 rotates about its shaft and an electrostatic latent image and a toner image are formed on the circumferential surface thereof. A photoconductive drum made of an amorphous silicon (a-Si) based material can be used as the photoconductive drum 321. The charger 322 uniformly charges the surface of the photoconductive drum 321. The exposure device 323 includes optical devices such as a laser light source, a mirror and a lens and irradiates the circumferential surface of the photoconductive drum 321 with light based on image data of a document image to form an electrostatic latent image.

The developing device 324 supplies toner particles to the circumferential surface of the photoconductive drum 321 to develop the electrostatic latent image formed on the photoconductive drum 321. The developing device 324 is for a two-component developer and includes a screw feeder, a magnetic roller and a developing roller. This developing device 324 is described in detail later.

The primary transfer roller 325 forms a nip portion together with the photoconductive drum 321 while sandwiching an intermediate transfer belt 331 provided in the intermediate transfer unit 33 and primarily transfers a toner image on the photoconductive drum 321 onto the intermediate transfer belt 331. The cleaning device 326 includes a cleaning roller and the like and cleans the circumferential surface of the photoconductive drum 321 after the transfer of a toner image.

The intermediate transfer unit 33 includes the intermediate transfer belt 331, a drive roller 332 and a driven roller 333. The intermediate transfer belt 331 is an endless belt mounted between the drive roller 332 and the driven roller 333, and toner images are transferred to the outer circumferential surface of the intermediate transfer belt 331 in a superimposing manner at the same position from a plurality of photoconductive drums 321 (primary transfer).

A secondary transfer roller 35 is arranged to face the circumferential surface of the drive roller 332. A nip portion between the drive roller 332 and the secondary transfer roller 35 serves as a secondary transfer portion 35A where a full-color toner image superimposed on the intermediate transfer belt 331 is transferred to a sheet. A secondary transfer bias potential having a polarity opposite to that of the toner image is applied to either one of the drive roller 332 and the secondary transfer roller 35 and the other roller is grounded.

The toner supply unit 34 includes a yellow toner container 34Y, a magenta toner container 34M, a cyan toner container 34C and a black toner container 34Bk. These toner containers 34Y, 34C, 34M and 34Bk are for storing toner particles of the respective colors and supply the toner particles of the respective colors to the developing devices 324 of the image forming units 32Y, 32M 32C and 32Bk corresponding to the respective colors Y, M, C and Bk via unillustrated supply paths. Each of the toner containers 34Y, 34C, 34M and 34Bk includes a conveying screw 341 for conveying the toner particles in the container to an unillustrated toner discharge opening. This conveying screw 341 is driven and rotated by an unillustrated driver unit, whereby the toner particles are supplied into the developing device 324.

The sheet feeder unit 40 includes sheet cassettes 40A, 40B arranged in two levels and adapted to store standard sized sheets P1 out of sheets on which an image forming process is to be performed. These sheet cassettes 40A, 40B can be withdrawn forward from the front side of the apparatus main body 10. In this specification, "standard sized sheets" are of a size, for example, in accordance with A series or B series defined by ISO216 and indicate sheets of a size generally used in general image forming apparatuses. For example, sheets of A3, A4, A5, B4, B5 size or the like are the standard sized sheets P1. Of course, size standards may conform to standards other than ISO216. For example, the standard sized sheets may be, for example, those based on standards such as ANSI, LDR, LGL, Folio, Quarto, Letter, EXEC and STMT.

The sheet cassette 40A (40B) includes a sheet storage portion 41 for storing a stack of sheets formed by stacking the standard sized sheets P1 one over another and a lift plate 42 for lifting up the sheet stack for sheet feeding. A pickup roller 43 and a pair of a feed roller 44 and a retard roller 45 are arranged above the right end of the sheet cassette 40A (40B). By driving the pickup roller 43 and the feed roller 44, the uppermost sheet P1 of the sheet stack in the sheet cassette 40A is fed one by one and conveyed to an upstream end of the conveyance path 50.

A sheet feed tray 46 for manual sheet feeding is provided on the right side surface 10R of the apparatus main body 10. The sheet feed tray 46 is openably and closably mounted to the apparatus main body 10 at its lower end part. In the case of manually feeding a sheet, a user opens the sheet feed tray 46 as shown and places the sheet thereon. The sheet placed on the sheet feed tray 46 is conveyed into the conveyance path 50 by driving a pickup roller 461 and a feed roller 462. An example in which this sheet feed tray 46 is used as a tray for feeding a long sheet P2 is illustrated in this embodiment.

The external cassette 70 is a sheet cassette optionally attached to the apparatus main body 10 for feeding a long sheet P2. The external cassette 70 includes a housing 71 with a sheet feed opening 711. A rolled paper sheet 72 which is a roll of a long sheet is housed in the housing 71. A roll core of the rolled paper sheet 72 is mounted on a rotary shaft 721 and the long sheet P2 is dispensed from the rolled paper sheet 72 by driving the rotary shaft 721. The long sheet P2 is fed onto the sheet feed tray 46 from the sheet feed opening 711 by a pair of feed rollers 74 via a folding driven roller 73.

In the case of causing the long sheet P2 to be fed, the user first opens the sheet feed tray 46, dispenses the long sheet P2 a predetermined length from the rolled paper sheet 72 and nips the leading end of this sheet between the pickup roller 461 and an unillustrated friction pad arranged right below. Thereafter, the long sheet P2 is conveyed to the conveyance path 50 by driving the pickup roller 461 and the feed roller 462 similarly to the above manual sheet feeding. A cutter 463 for cutting the long sheet P2 to a predetermined length is arranged near the feed roller 462. A cutter configured such that a moving body fitted with a cutting blade is moved in a width direction of the sheet can be adopted as the cutter 463.

In this specification, the "long sheet" indicates a sheet, the size of which in a sub scanning direction is longer than standard sized sheets and, in this embodiment, means a sheet, the size of which in the sub scanning direction is longer than A3 size sheets or equivalent sheets. The size of the long sheet in the sub scanning direction is, for example, about 500 mm to 1500 mm.

The conveyance path 50 includes a main conveyance path 50A for conveying a sheet (standard sized sheet P1 or long sheet P2) from the sheet feeder unit 40 to the exit of the fixing unit 60 via the image forming station 30, a reversing conveyance path 50B for returning a sheet having one side printed to the image forming station 30 in the case of printing both sides of the sheet, a switchback conveyance path 50C for conveying the sheet from a downstream end of the main conveyance path 50A toward an upstream end of the reversing conveyance path 50B, and a horizontal conveyance path 50D for conveying the sheet in a horizontal direction from the downstream end of the main conveyance path 50A to the sheet discharge opening 10E provided on a left side surface 10L of the apparatus main body 10. Most of this horizontal conveyance path 50D is formed by the sheet conveyance path provided in the conveying unit 55.

A pair of registration rollers 51 is arranged at a side of the main conveyance path 50A upstream of the secondary transfer portion 35A. A sheet is temporarily stopped by the pair of registration rollers 51 in a stopped state for skew correction. Thereafter, the pair of registration rollers 51 are driven and rotated by a drive motor (not shown) at a predetermined timing for image transfer, whereby the sheet is fed to the secondary transfer portion 35A. Besides, a plurality of conveyor rollers 52 for conveying the sheet are arranged in the main conveyance path 50A. The same applies to the other conveyance paths 50B, 50C and 50D.

A discharge roller 53 is arranged at the most downstream end of the conveyance path 50. The discharge roller 53 feeds the sheet to an unillustrated post-processing apparatus arranged next to the left side surface 10L of the apparatus main body 10 through the sheet discharge opening 10E. Note that a sheet discharge tray is provided below the sheet discharge opening 10E in the image forming apparatus to which the post-processing apparatus is not attached.

The conveying unit 55 is a unit for conveying a sheet exiting from the fixing unit 60 to the sheet discharge opening 10E. In the image forming apparatus 1 of this embodiment, the fixing unit 60 is arranged at a side near the right side surface 10R of the apparatus main body 10, and the sheet discharge opening 10E is arranged on the left side surface 10L of the apparatus main body 10 facing the right side surface 10R. Accordingly, the conveying unit 55 conveys the sheet in the horizontal direction from the right side surface 10R toward the left side surface 10L of the apparatus main body 10.

The fixing unit 60 is a fixing device of an induction heating type for performing a fixing process of fixing a toner image to a sheet, and includes a heating roller 61, a fixing roller 62, a pressure roller 63, a fixing belt 64 and an induction heating unit 65. The pressure roller 63 is pressed into contact with the fixing roller 62, thereby forming a fixing nip portion. The heating roller 61 and the fixing belt 64 are induction-heated by the induction heating unit 65 and apply that heat to the fixing nip portion. The sheet passes through the fixing nip portion, whereby the toner image transferred to the sheet is fixed to the sheet.

Figure 2:
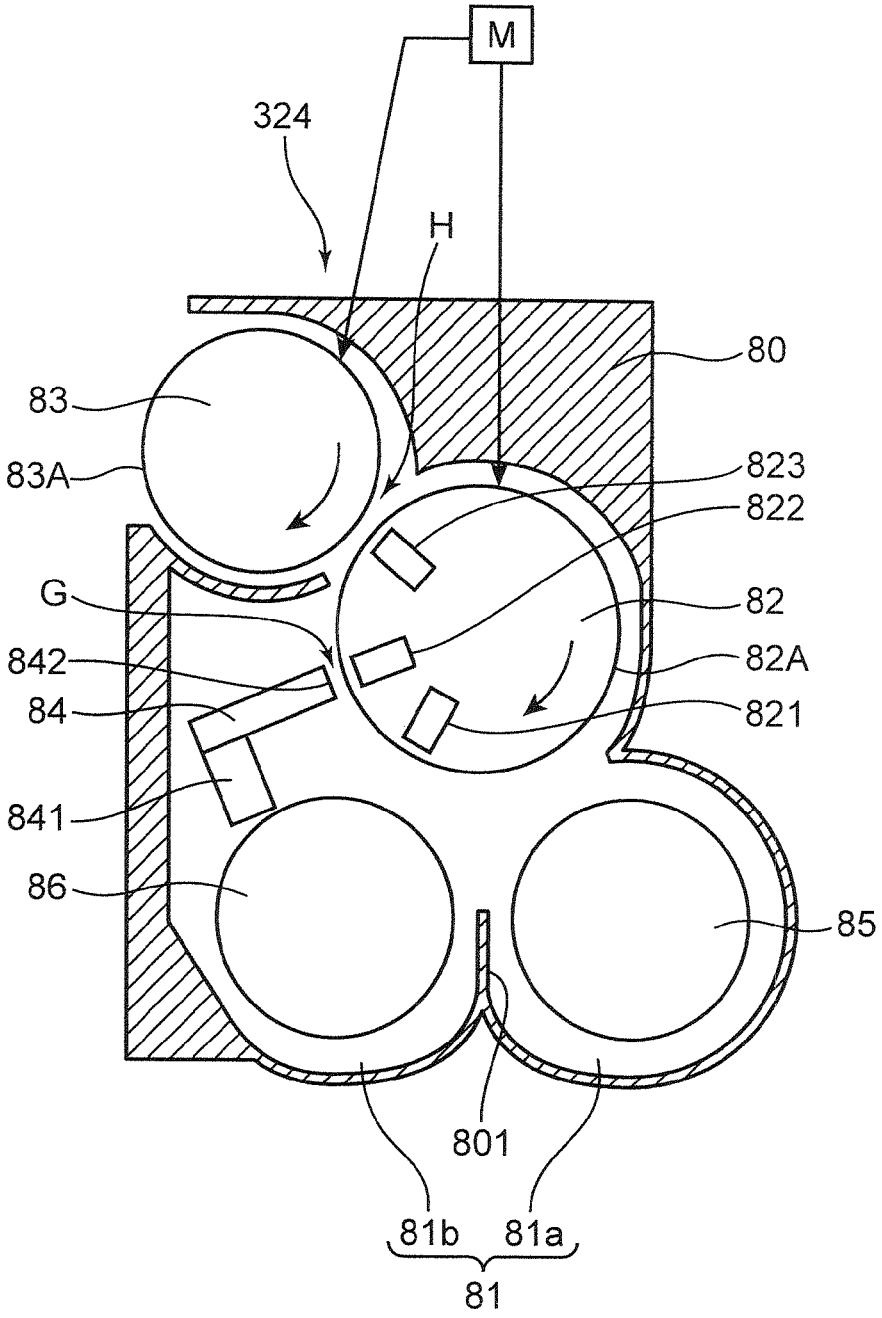
FIG. 2 is a vertical sectional view of a developing device.
Figure 3:
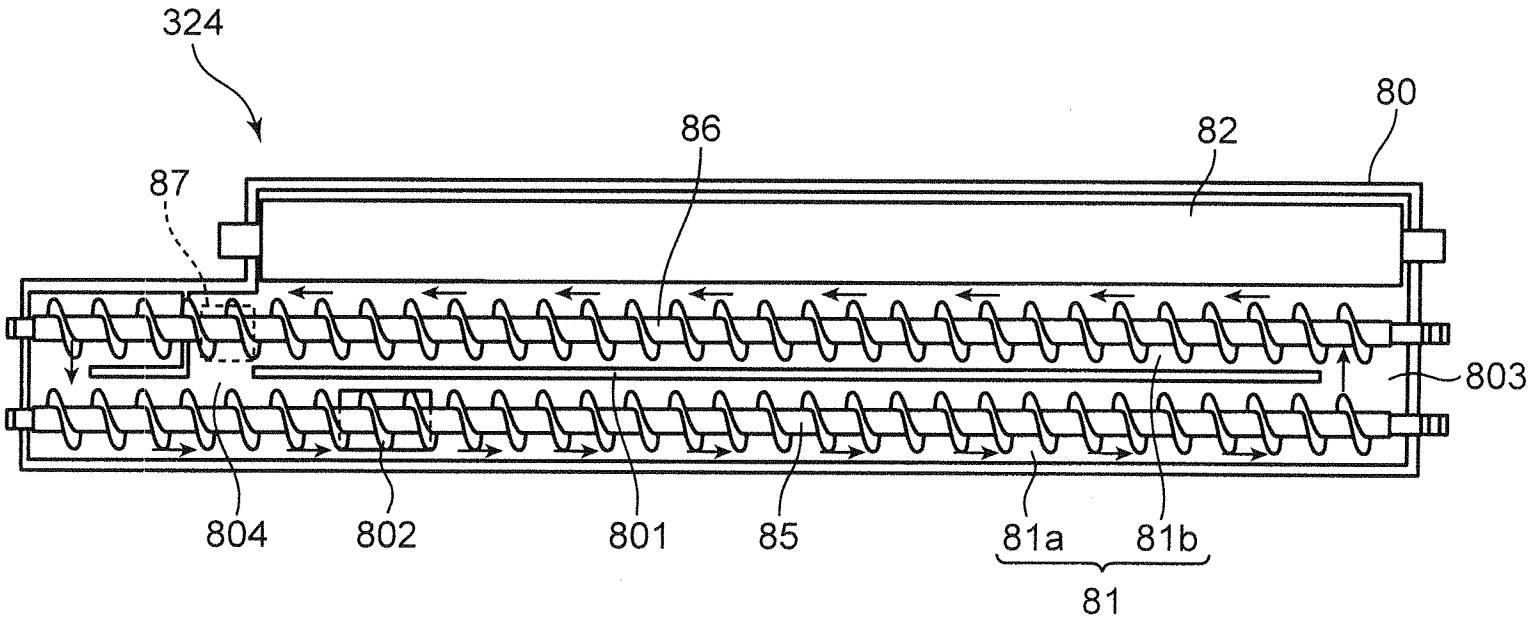
FIG. 3 is a horizontal sectional view of the developing device.

Next, the developing device 324 is described in detail. FIG. 2 is a vertical sectional view schematically showing the internal structure of the developing device 324, and FIG. 3 is a horizontal sectional view of the developing device 324. The developing device 324 includes a developer housing 80 defining the internal space of the developing device 324. This developer housing 80 includes a developer storing portion 81 which is a cavity for storing a developer containing nonmagnetic toner particles and magnetic carrier particles and capable of conveying the developer while agitating it. Further, a magnetic roller 82 (developer bearing member) arranged above the developer storing portion 81, a developing roller 83 (toner bearing member) arranged to face the magnetic roller 82 at a position obliquely above the magnetic roller 82 and a developer restricting blade 84 (restricting member) arranged to face the magnetic roller 82 are included in the developer housing 80.

The developer storing portion 81 includes two adjacent developer storage chambers 81*a*, 81*b* extending in a longitudinal direction of the developing device 324. The developer storage chambers 81*a*, 81*b* are partitioned by a partition plate 801 which is integrally formed to the developer housing 80 and extends in the longitudinal direction, but communicate with each other via communication paths 803, 804 at both ends in the longitudinal direction as shown in FIG. 3. Screw feeders 85, 86 for agitating and conveying the developer by rotating about a shaft are housed in the respective developer storage chambers 81, 81*b*. The screw feeders 85, 86 are driven and rotated by an unillustrated driving mechanism and the rotating directions thereof are set to be opposite to each other. In this way, the developer is conveyed in a circulating manner while being agitated between the developer storage chambers 81*a* and 81*b* as shown by arrows in FIG. 3. By this agitation, the toner particles and the carrier particles are mixed and the toner particles are, for example, negatively charged.

The magnetic roller 82 carries a layer of the developer containing toner particles and carrier particles while rotating about a shaft. The magnetic roller 82 is arranged along the longitudinal direction of the developing device 324 and rotatable clockwise in FIG. 2. A fixed so-called magnetic roll (not shown) is arranged in the magnetic roller 82. The magnetic roll includes a plurality of magnetic poles and, in this embodiment, includes a scoop-up pole 821, a restricting pole 822 and a main pole 823. The scoop-up pole 821 faces the developer storing portion 81, the restricting pole 822 faces the developer restricting blade 84 and the main pole 823 faces the developing roller 83.

The magnetic roller 82 magnetically scoops up (receives) the developer from the developer storing portion 81 onto a circumferential surface 82A thereof by a magnetic force of the scoop-up pole 821. The scooped-up developer is magnetically held as a developer layer (magnetic brush layer) on the circumferential surface 82A of the magnetic roller 82 and conveyed toward the developer restricting blade 84 according to the rotation of the magnetic roller 82.

The developer restricting blade 84 is arranged upstream of the developing roller 83 in a rotating direction of the magnetic roller 82 and restricts the layer thickness of the developer layer magnetically adhering to the circumferential surface 82A of the magnetic roller 82. The developer restricting blade 84 is a plate member made of a magnetic material and extending in a longitudinal direction of the magnetic roller 82 and is supported by a predetermined supporting member 841 fixed at a suitable position of the developer housing 80. Further, the developer restricting blade 84 has a restricting surface 842 (i.e. leading end surface of the developer restricting blade 84) for forming a restricting gap G of a predetermined dimension between the circumferential surface 82A of the magnetic roller 82 and the restricting surface 842.

The developer restricting blade 84 made of the magnetic material is magnetized by the restricting pole 822 of the magnetic roller 82 and a magnetic path is formed between the restricting surface 842 of the developer restricting blade 84 and the restricting pole 822, i.e. in the restricting gap G. When the developer layer adhering to the circumferential surface 82A of the magnetic roller 82 by the action of the scoop-up pole 821 is conveyed into the restricting gap G according to the rotation of the magnetic roller 82, the layer thickness of the developer layer is restricted in the restricting gap G. In this way, a uniform developer layer of a predetermined thickness is formed on the circumferential surface 82A.

Note that a phenomenon such as one in which external additives bite into the surfaces of the toner particles may occur to deteriorate the toner particles due to stress generated when the developer layer thickness is restricted in the restricting gap G. This deterioration of the toner particles tends to be accelerated as magnetic flux density in the restricting gap G increases and the number of passages of the toner particles through the restricting gap G increases, i.e. as the rotation speed of the magnetic roller 82 increases.

The developing roller 83 is arranged to extend along the longitudinal direction of the developing device 324 and in parallel to the magnetic roller 82 and rotatable clockwise in FIG. 2. The developing roller 83 has a circumferential surface 83A which receives the toner particles from the developer layer and carries a toner layer while rotating in contact with the developer layer held on the circumferential surface 82A of the magnetic roller 82. When a developing operation is performed, the toner particles of the toner layer are supplied to the circumferential surface of the photoconductive drum 321.

The developing roller 83 and the magnetic roller 82 are rotated and driven by a drive source M (driving mechanism). A clearance H of a predetermined dimension is formed between the circumferential surface 83A of the developing roller 83 and the circumferential surface 82A of the magnetic roller 82. The clearance H is set, for example, at about 130 μm. The developing roller 83 is arranged to face the photoconductive drum 321 through an opening formed in the developer housing 80, and a clearance of a predetermined dimension is also formed between the circumferential surface 83A and the circumferential surface of the photoconductive drum 321.

As shown in FIG. 3, a toner density sensor 87 for measuring the density of the toner particles in the developer housing 80 is arranged in the developer housing 80. The toner density sensor 87 includes, for example, a magnetic permeability sensor for measuring magnetic permeability and outputs a voltage corresponding to the magnetic permeability that varies according to the toner density. An output of the toner density sensor 87 is expressed, for example, in 10 bits and indicated as a value of 0 to 1023. Since the toner particles are a nonmagnetic substance in this embodiment, an output bit value increases as the toner density decreases and, conversely, the output bit value decreases as the toner density increases.

Figure 4:
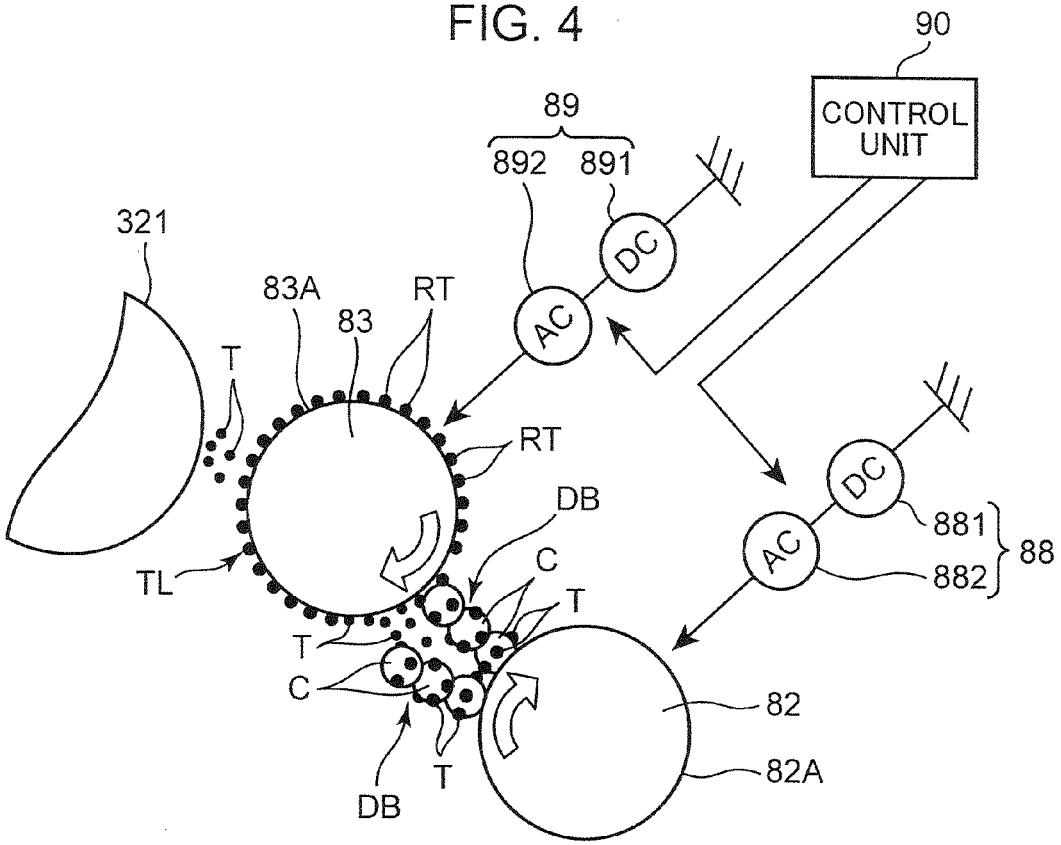
FIG. 4 is a diagram showing a developing operation of the developing device.

Next, a configuration for bias application and a developing operation of the developing device 324 are described with reference to FIG. 4. The developing device 324 further includes a first applying unit 88 (bias applying unit), a second applying unit 89 (bias applying unit) and a control unit 90 for controlling the first and second applying units 88, 89 to control the developing operation. As shown in FIG. 4, the first applying unit 88 includes a DC voltage source 881 and an AC voltage source 882 connected in series and is connected to the magnetic roller 82. A voltage obtained by superimposing an AC bias output from the AC voltage source 882 on a DC bias output from the DC voltage source 881 is applied to the magnetic roller 82. The second applying unit 89 includes a DC voltage source 891 and an AC voltage source 892 connected in series and is connected to the developing roller 83. A voltage obtained by superimposing an AC bias output from the AC voltage source 892 on a DC bias output from the DC voltage source 891 is applied to the developing roller 83.

A magnetic brush layer on the circumferential surface 82A of the magnetic roller 82 is conveyed toward the developing roller 83 according to the rotation of the magnetic roller 82 after the layer thickness thereof is uniformly restricted by the developer restricting blade 84. Thereafter, a multitude of magnetic brushes DB in the magnetic brush layer come into contact with the rotating circumferential surface 83A of the developing roller 83 in an area of the clearance H (FIG. 2).

At this time, the control unit 90 controls the first and second applying units 88, 89 to apply predetermined DC biases and AC biases respectively to the magnetic roller 82 and the developing roller 83. This results in a predetermined potential difference between the circumferential surface 82A of the magnetic roller 82 and the circumferential surface 83A of the developing roller 83. By this potential difference, only toner particles T move to the circumferential surface 83A from the magnetic brushes DB at a position where the circumferential surfaces 82A, 83A face each other (position where the main pole 823 (FIG. 2) and the circumferential surface 83A face each other) and carrier particles C of the magnetic brushes DB remain on the circumferential surface 82A. In this way, a toner layer TL of a predetermined thickness is carried on the circumferential surface 83A of the developing roller 83.

The toner layer TL on the circumferential surface 83A is conveyed toward the circumferential surface of the photoconductive drum 321 according to the rotation of the developing roller 83. Since a superimposed voltage of an AC voltage and a DC voltage is also applied to the photoconductive drum 321, there is a predetermined potential difference between the circumferential surface of the photoconductive drum 321 and the circumferential surface 83A of the developing roller 83. By this potential difference, the toner particles T of the toner layer TL move to the circumferential surface of the photoconductive drum 321 (supply of the toner particles). In this way, an electrostatic latent image on the circumferential surface of the photoconductive drum 321 is developed to form a toner image.

Figure 5:
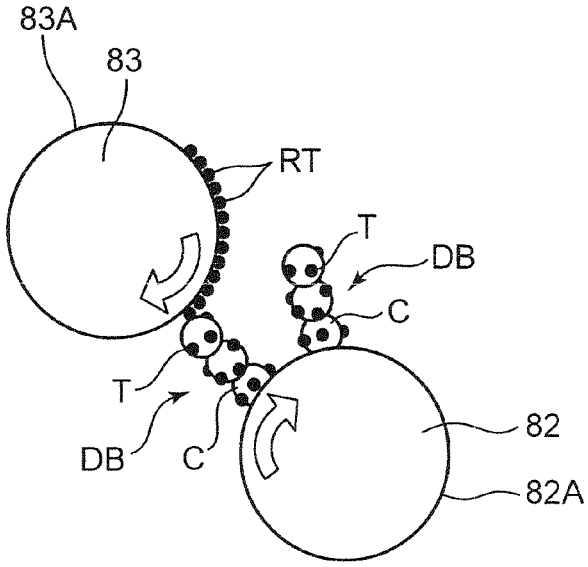
FIG. 5 is a diagram showing an operation of stripping toner particles from a developing roller.

FIG. 5 is a diagram showing a toner particle stripping operation from the developing roller 83 to the magnetic roller 82. In an actual developing operation, out of toner particles T in the toner layer TL, there are residual toner particles RT remaining on the circumferential surface 83A without moving to the photoconductive drum 321. The residual toner particles RT are collected toward the magnetic roller 82 by a scraping force by the magnetic brushes DB and an electrical force between the two rollers 82, 83 when being conveyed to the position, where the circumferential surface 83A and the circumferential surface 82A of the magnetic roller 82 face each other, according to the rotation of the developing roller 83. The magnetic brushes DB including the collected residual toner particles RT are separated from the circumferential surface 82A by a magnetic force of a separation pole (not shown) of the magnetic roll and returned to the developer storing portion 81 (FIG. 2) when being conveyed to a side downstream of the main pole 823 according to the rotation of the magnetic roller 82.

Note that the above stripping operation is promoted by reducing the potential difference between the magnetic roller 82 and the developing roller 83. Accordingly, it is preferable to forcibly separate the residual toner particles RT from the developing roller 83 and refresh the circumferential surface 83A, for example, by temporarily reducing the potential difference between sheets.

However, in the case of performing a developing operation on long sheets P2, the above stripping operation cannot be performed at a short time interval since a developing time for one sheet is longer, i.e. a timing between sheets does not come very often. Thus, the toner particles stay on the developing roller 83 for a longer time and tends to be excessively charged and deteriorated. If the toner particles are excessively charged, the toner particles T of the toner layer TL are unlikely to move to the circumferential surface of the photoconductive drum 321 and an image defect such as a solid image blank area occurs. In view of this point, the image forming apparatus 1 of this embodiment has an electrical configuration with a function of maximally preventing the deterioration of toner particles even if a developing operation is performed on long sheets P2. Hereinafter, this electrical configuration is described.

Figure 6:
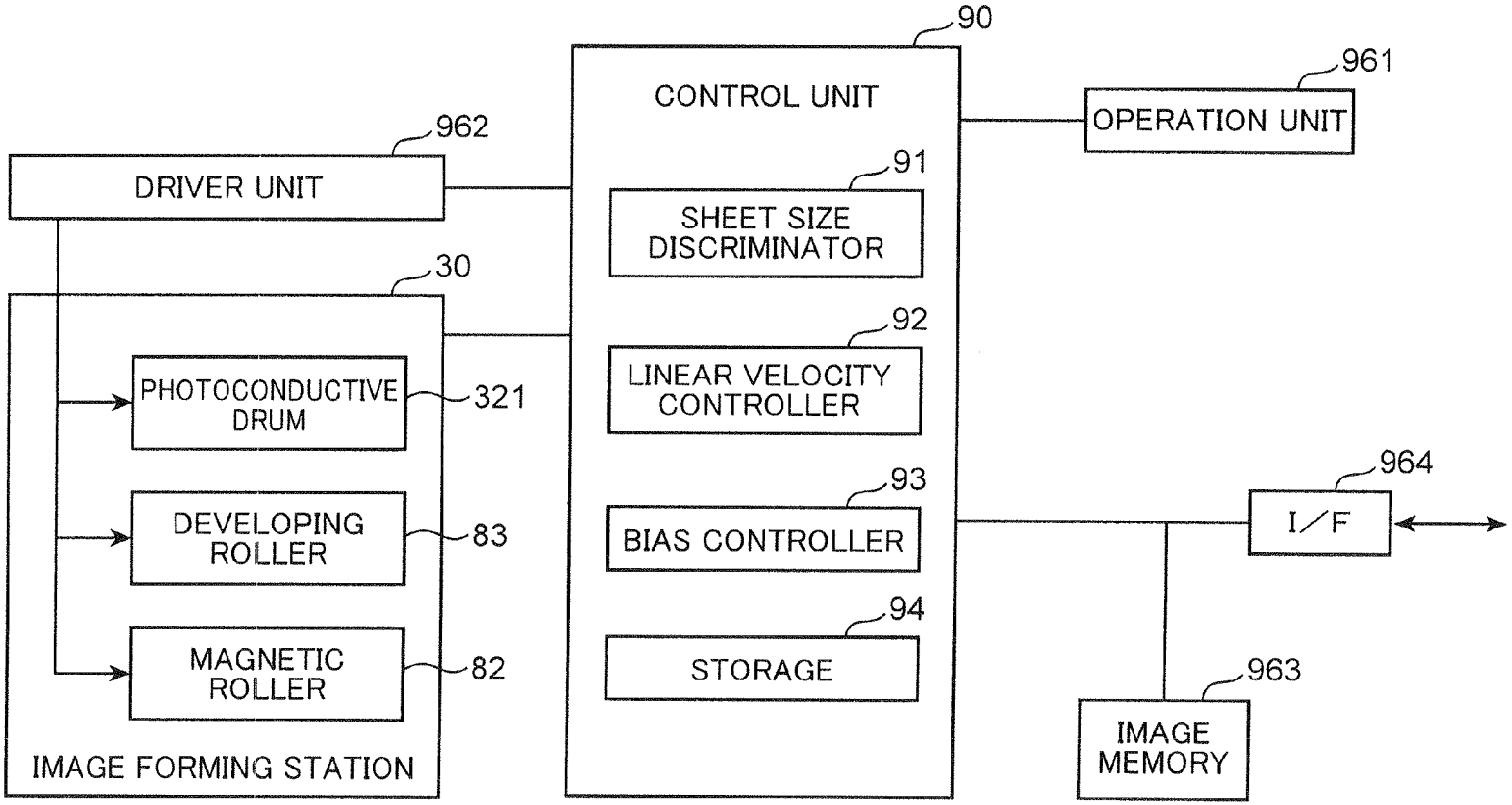
FIG. 6 is a functional block diagram of a control unit.

The image forming apparatus 1 includes the control unit 90 for centrally controlling the operation of the respective units of the image forming apparatus 1. FIG. 6 is a functional block diagram of the control unit 90. The control unit 90 is composed of a CPU (Central Processing Unit), a ROM (Read Only Memory) storing a control program, a RAM (Random Access Memory) used as a work area of the CPU and the like. Further, the image forming apparatus 1 includes an operation unit 961, a driver unit 962 (driving means; the drive source M shown in FIG. 2 is a part of the driving means), an image memory 963 and an I/F (interface) 964 in addition to the configuration described with reference to FIGS. 1 to 5.

The operation unit 961 includes a liquid crystal touch panel, a numerical keypad, a start key, setting keys and the like and receives operations and various settings made on the image forming apparatus 1 by the user. For example, an operation of selecting a sheet on which the image forming process is to be performed is also received in this operation unit 961.

The driver unit 962 includes a motor and a gear mechanism and a clutch mechanism for transmitting a torque of the motor, and drives and rotates the photoconductive drums 321, the developing rollers 83 and the magnetic rollers 82. The driver unit 962 is capable of individually driving and rotating the photoconductive drums 321, the developing rollers 83 and the magnetic rollers 82 and linear velocities of these drums and rollers are individually set by a control of a linear velocity controller 92 to be described later.

The image memory 963 temporarily stores, for example, print image data given from an external apparatus such as a personal computer when this image forming apparatus 1 functions as a printer. Further, the image memory 963 temporarily stores image data optically read by the ADF 20 when the image forming apparatus 1 functions as a copier.

The I/F 964 is an interface circuit for realizing a data communication with external apparatuses. For example, the I/F 964 generates a communication signal in accordance with a communication protocol of a network connecting the image forming apparatus 1 and external apparatuses and converts a communication signal from the network into data of a format processable in the image forming apparatus 1. A print instruction signal transmitted from a personal computer or the like is fed to the control unit 90 via the I/F 964. Image data is stored in the image memory 963 via the I/F 964.

The control unit 90 functions to include a sheet size discriminator 91, the linear velocity controller 92 (first controller), a bias controller 93 (second controller) and a storage 94 by the CPU executing the control program stored in the ROM.

Figure 7A:
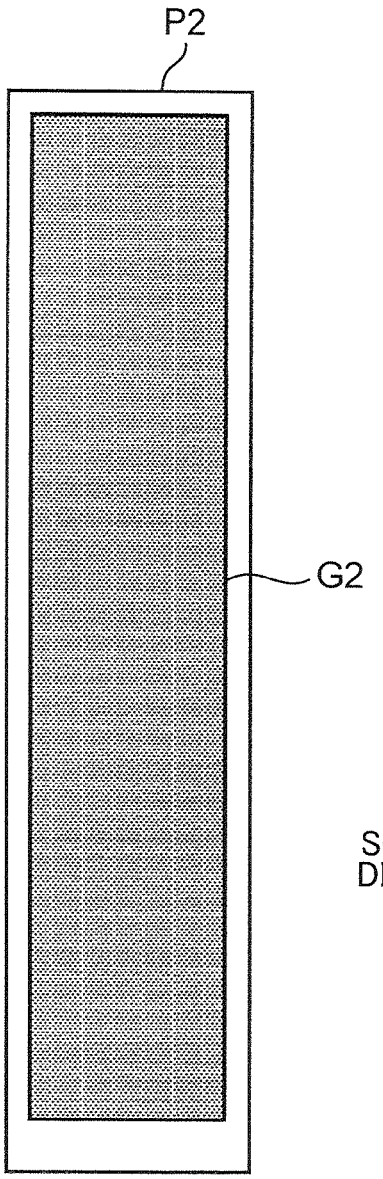
FIGS. 7A and 7B are diagrams respectively showing a long sheet and a standard sized sheet.
Figure 7B:
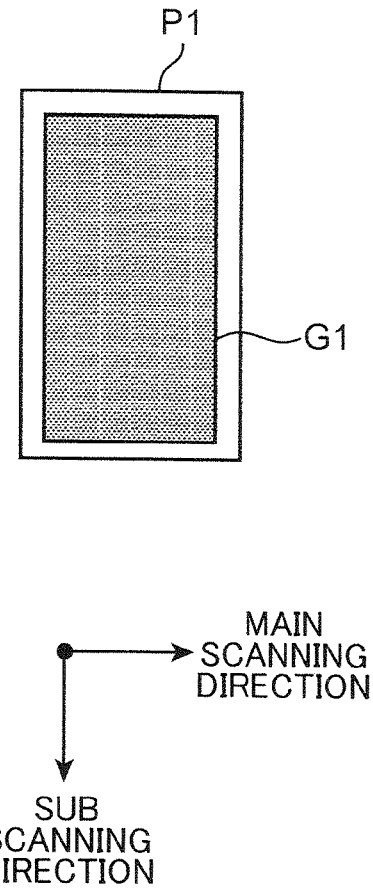

The sheet size discriminator 91 discriminates the size of a sheet to which a toner image is to be transferred. For this discrimination, the sheet size discriminator 91 refers to image data stored in the image memory 963 and determines the size of the sheet based on a data width in the sub scanning direction or the like. Whether a sheet to be printed is a long sheet P2 shown in FIG. 7A or a standard sized sheet P1 shown in FIG. 7B is discriminated by this sheet size discriminator 91. Of course, in the case of the standard sized sheet P1, the size of that standard sized sheet P1 is also discriminated. Further, in the case of the long sheet P2, length information in the sub scanning direction is specified. The length information is used for a control of the dispensed amount of the long sheet P2 from the external cassette and an operation control of the cutter 463.

If the toner particles stay on the developing roller 83 for a long time, they are excessively charged to be deteriorated. As shown in FIG. 7A, a toner image G2 corresponding to the sheet size is transferred to one long sheet P2. Similarly, a toner image G1 is transferred to one standard sized sheet P1. The above stripping operation is not performed and the toner particles stay on the developing roller 83 while the toner image G2 having a longer size in the sub scanning direction than the toner image G1 is formed. In this case, the residual toner particles more frequently come into contact with the magnetic brushes DB of the magnetic roller 82 and the toner particles carried on the developing roller 83 are excessively charged. Note that since a large amount of toner particles move from the developing roller 83 to the photoconductive drum 321 when a coverage rate of the toner image G2 is high, the amount of the toner particles staying on the developing roller 83 becomes relatively smaller. However, since a ratio of the toner particles staying on the developing roller 83 increases when the coverage rate is low, the deterioration of the toner particles due to excessive charging becomes notable.

The linear velocity controller 92 controls a linear velocity D of the photoconductive drum 321, a linear velocity S of the developing roller 83 and a linear velocity M of the magnetic roller 82 by controlling the driver unit 962 to suppress the deterioration of the toner particles associated with the development of the long sheet P2. The linear velocity controller 92 changes the linear velocities D, S and M depending on whether the size discrimination result by the sheet size discriminator 91 is the standard sized sheet P1 or the long sheet P2.

As described above, the bias controller 93 controls the developing operation and the toner particle stripping operation by the developing device 324 by controlling biases to be applied to the magnetic roller 82 and the developing roller 83 by the first and second applying units 88, 89. The bias controller 93 changes the settings of the biases depending on whether the size discrimination result by the sheet size discriminator 91 is the standard sized sheet P1 or the long sheet P2.

The storage 94 stores various set values and parameters. Particularly in this embodiment, the storage 94 stores the values of the linear velocities D, S and M and the set bias values when a sheet to be printed is the standard sized sheet P1 and this sheet is the long sheet P2. The linear velocity controller 92 and the bias controller 93 refer to the storage 94 and set the linear velocities and the biases in correspondence with the size discrimination result by the sheet size discriminator 91.

The contents of the controls executed by the linear velocity controller 92 and the bias controller 93 are described in detail by way of an example in which specific numerical values are set. If the sheet size discriminator 91 discriminates that a sheet to which a toner image is to be transferred is a standard sized sheet P1, the linear velocity controller 92 sets the linear velocity D of the photoconductive drum 321 at a predetermined velocity (first velocity) and sets the linear velocity S so that S/D, which is a ratio of the linear velocity S of the developing roller 83 to this linear velocity D, has predetermined value (first value). The linear velocity M of the magnetic roller 82 is also set at a predetermined velocity (third velocity). Further, the bias controller 93 controls biases to be applied to the magnetic roller 82 and the developing roller 83 so that the thickness of a toner layer to be carried on the developing roller 83 is a predetermined layer thickness (first layer thickness). Specifically, necessary biases are changed out of AC biases and DC biases applied to the respective magnetic roller 82 and the developing roller 83 by the first and second applying units 88, 89.

The following is an example of the linear velocities and the biases set for the development of the standard sized sheet P1.

Linear velocity D of photoconductive drum 321: 300 mm/sec

Linear velocity S of developing roller 83: 450 mm/sec
Linear velocity M of magnetic roller 82: 675 mm/sec
S/D (ratio of linear velocity S to linear velocity D): 1.5
M/S (ratio of linear velocity M to linear velocity S): 1.5
DC bias Vmag_dc of magnetic roller 82: 350 V
DC bias Vslv_dc of developing roller 83: 50 V
AC bias Vmag_ac of magnetic roller 82: 2500 V (4700 Hz)
AC bias Vslv_ac of developing roller 83: 1500 V (4700 Hz)

Contrary to this, if the sheet size discriminator 91 discriminates that a sheet to which a toner image is to be transferred is a long sheet P2, the linear velocity controller 92 sets the linear velocity D at a velocity (second velocity) slower than the velocity for the standard sized sheet P1 and sets the linear velocity S so that the S/D has a value (second value) larger than the value for the standard sized sheet P1. The linear velocity controller 92 also sets the linear velocity M at a velocity (fourth velocity) slower than the velocity for the standard sized sheet P1. Further, the bias controller 93 controls biases to be applied to the magnetic roller 82 and the developing roller 83 so that the thickness of a toner layer to be carried on the developing roller 83 is a layer thickness (second layer thickness) smaller than the layer thickness for the standard sized sheet P1.

The following is an example of the linear velocities and the biases set for the development of the long sheet P2.

Linear velocity D of photoconductive drum 321: 150 mm/sec

Linear velocity S of developing roller 83: 300 mm/sec
Linear velocity M of magnetic roller 82: 450 mm/sec
S/D (ratio of linear velocity S to linear velocity D): 2.0
M/S (ratio of linear velocity M to linear velocity S): 1.5
DC bias Vmag_dc of magnetic roller 82: 300 V
DC bias Vslv_dc of developing roller 83: 50 V
AC bias Vmag_ac of magnetic roller 82: 2500 V (4700 Hz)
AC bias Vslv_ac of developing roller 83: 1500 V (4700 Hz)

In the above setting example of the linear velocities and the biases, the linear velocity D of the photoconductive drum 321 is reduced to ½ and the linear velocity S of the developing roller 83 is reduced to ⅔ in the development of the long sheet P2 as compared with the corresponding linear velocities for the standard sized sheet P1. Further, the linear velocity M of the magnetic roller 82 is also reduced to ⅔ to correspond to a reduction in the linear velocity S. In this way, for the development of the long sheet P2, S/D is changed from 1.5 to 2.0, whereas M/S is maintained at a constant value. Further, as for the biases, only the DC bias Vmag_dc of the magnetic roller 82 is reduced by 50V and the other biases are unchanged.

Figure 8:
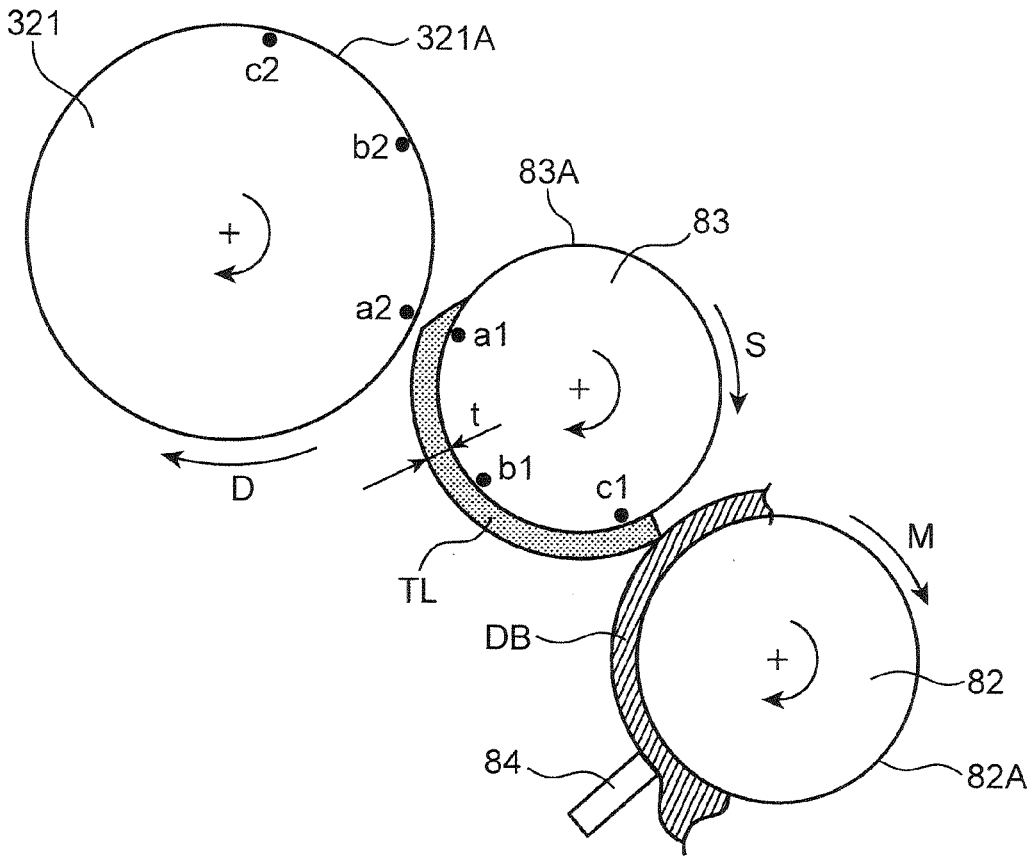
FIG. 8 is a diagram showing linear velocities of a photoconductive drum, a developing roller and a magnetic roller.

FIG. 8 is a diagram showing a relationship between the linear velocities of the photoconductive drum 321, the developing roller 83 and the magnetic roller 82 and the developing operation. As already described, the toner particles of the magnetic brushes DB of the magnetic roller 82 move to the circumferential surface 83A of the developing roller 83 due to the potential difference between the circumferential surface 82A of the magnetic roller 82 and the circumferential surface 83A of the developing roller 83. The amount of the moving toner particles, i.e. the layer thickness of the toner layer TL carried on the circumferential surface 83A depends on the magnitude of the potential difference. In the above bias setting example, by reducing the DC bias Vmag_dc as described above, the potential difference between the circumferential surface 82A and the circumferential surface 83A at the time of developing the standard sized sheet P1 is Vmag_dc−Vslv_dc=300 V (first potential difference) while being Vmag_dc−Vslv_dc=250 V (second potential difference) at the time of developing the long sheet P2. Accordingly, the layer thickness of the toner layer TL becomes smaller at the time of developing the long sheet P2 than at the time of developing the standard sized sheet P1. This can reduce the amount of the toner particles remaining on the developing roller 83 without being supplied to the photoconductive drum 321.

On the other hand, the amount of toner particles supplied to the photoconductive drum 321 becomes insufficient as the toner layer TL becomes thinner. The insufficient amount of toner particles is compensated by increasing the value of S/D, i.e. by making the linear velocity S of the developing roller 83 relatively faster than the linear velocity D of the photoconductive drum 321 to increase the supply amount of the toner particles. In this case, it is preferable to reduce the linear velocity S while increasing the value of S/D.

It is assumed that the toner layer TL having a predetermined layer thickness t is carried on the circumferential surface 83A of the developing roller 83 by the linear velocities and the biases set at the time of developing the standard sized sheet P1 as shown in FIG. 8. It is also assumed that a sufficient amount of toner particles carried right on points a1, b1 and c1 of the circumferential surface 83A is supplied to points a2, b2 and c2 of the circumferential surface 321A of the photoconductive drum 321 under an S/D condition in this case. If S/D remains unchanged when the toner layer TL becomes thinner, the amount of toner particles supplied to the points a2, b2 and c2 become insufficient as a matter of course. However, at the time of developing the long sheet P2, toner particles can be sufficiently supplied also by the thinner toner layer TL by increasing the value of S/D. That is, the toner particles carried between the points a1 and c1 of the circumferential surface 83A are supplied to between the points a2 and c2 of the circumferential surface 321A at the time of developing the standard sized sheet P1. By increasing S/D, the toner particles carried between the points a1 to c1 of the circumferential surface 83A can be, for example, supplied to between the points a2 and b2 of the circumferential surface 321A.

By increasing the value of S/D in this way, a sufficient supply amount of the toner particles can be ensured despite of the thinner toner layer TL. However, if the developing roller 83 is rotated at a high speed, some toner particles remaining on the circumferential surface 83A and the magnetic brushes DB more frequently come into contact, leading to excessive charging of the toner particles. In view of this point, the linear velocity D of the photoconductive drum 321 is reduced to ½ in the above setting example, whereby the linear velocity S of the developing roller 83 is reduced while the value of S/D is increased. Thus, it can be prevented that the developing roller 83 is rotated at an excessive linear velocity while carrying the toner particles to trigger the deterioration of the toner particles.

In the case of reducing the linear velocity S of the developing roller 83, the linear velocity M of the magnetic roller 82 can also be reduced. If a necessary amount of toner particles is supplied to the developing roller 83 from the magnetic brushes DB at a predetermined value of M/S (=1.5) at the time of developing the standard sized sheet P1, it is allowed to reduce the linear velocity M in proportion to a reduction in the linear velocity S and maintain M/S at the same value at the time of developing the long sheet P2. Although the linear velocity M is reduced at the same rate as the linear velocity S to maintain M/S at the same value in the above setting example, the value of M/S may not necessarily remain unchanged and may slightly vary.

The deterioration of the toner particles can be suppressed by reducing the linear velocity M of the magnetic roller 82. Specifically, the developer carried on the circumferential surface 82A of the magnetic roller 82 is stressed and likely to be deteriorated every time passing the arrangement position of the developer restricting blade 84. However, by setting the linear velocity M to be relatively slower at the time of developing the long sheet P2, the number of passages at the arrangement position of the developer restricting blade 84 can be reduced. This can also reduce the number of times the developer is stressed, thereby suppressing the deterioration of the toner particles.

As described above, the deterioration of the toner particles can be suppressed by changing the linear velocities and the biases at the time of developing the standard sized sheet P1 and at the time of developing the long sheet P2. The above setting example of the linear velocities and the biases are an example and these can be set in various manner. For example, although the linear velocity D is reduced to ½ at the time of developing the long sheet P2 as against at the time of developing the standard sized sheet P1, the linear velocity D may be reduced within a range of about ¼ to ¾ according to the length, the coverage rate and the like of the long sheet P2. Further, the value of S/D can also be set at an appropriate value as long as it is significantly increased at the time of developing the long sheet P2. Further, the layer thickness of the toner layer TL may be controlled by adjusting the value of M/S in addition to or instead of the adjustment of the potential difference between the developing roller 83 and the magnetic roller 82.

Figure 9:
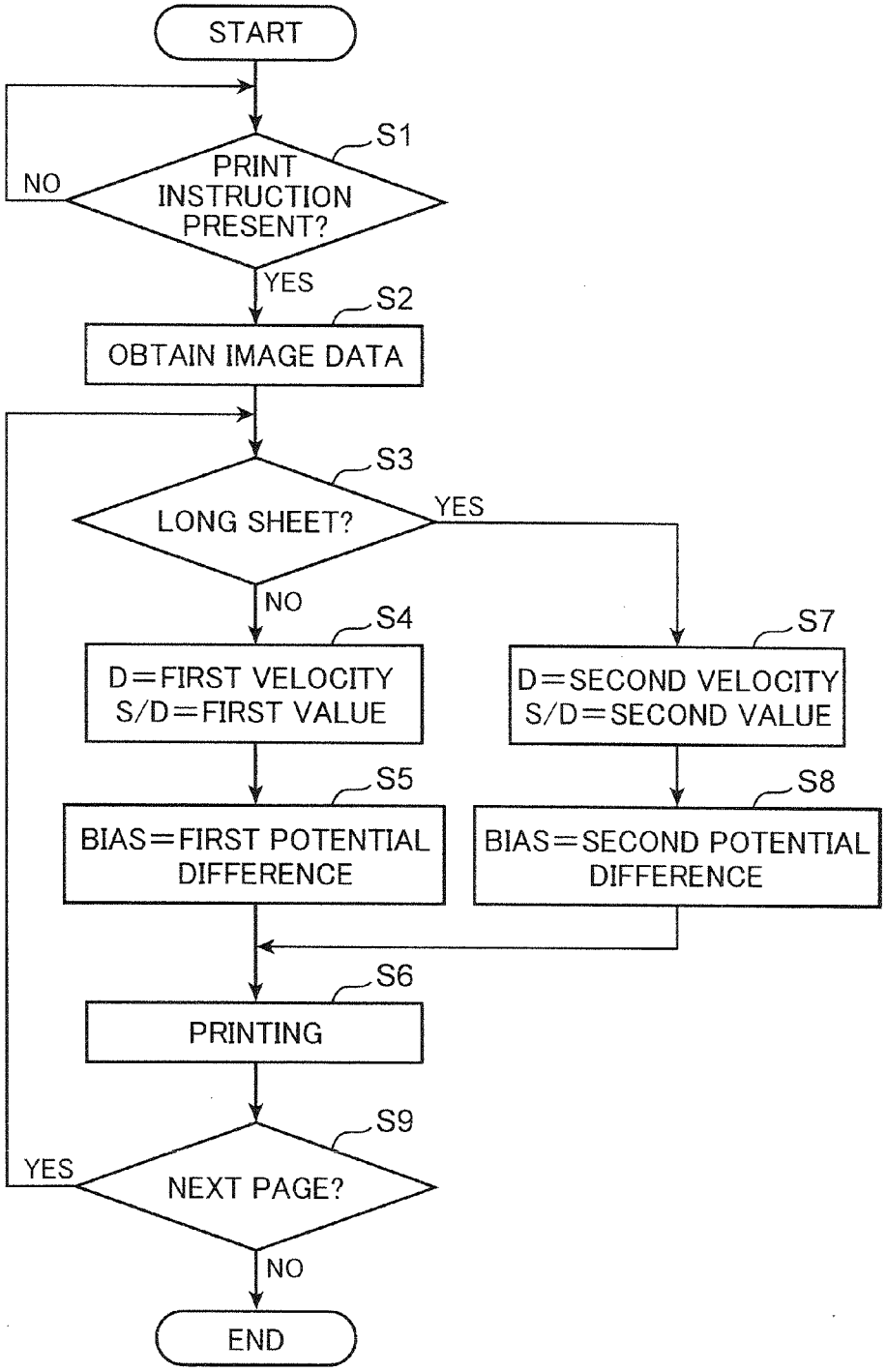
FIG. 9 is a flow chart showing an operation of setting linear velocities and biases by the control unit.

Next, an operation of setting the linear velocities and the biases by the control unit 90 is described based on a flow chart shown in FIG. 9. Here is supposed a case where the image forming apparatus 1 operates as a printer. First, it is determined whether or not a print instruction has been given from an external apparatus to the control unit 90 via the I/F 964 (Step S1). If no print instruction has been given (NO in Step S1), this routine waits on standby.

If the print instruction has been given (YES in Step S1), corresponding image data is written in the image memory 963 (Step S2). Thereafter, the image data is referred to by the sheet size discriminator 91 and it is determined whether or not the first page image data of the image data is standard sized sheet data or long sheet data (Step S3).

If the sheet size discriminator 91 determines the "standard sized sheet data" (NO in Step S3), the linear velocity controller 92 subsequently reads linear velocity parameters set in advance for standard sized sheet development from the storage 94, sets the linear velocity D of the photoconductive drum 321 at a predetermined first velocity (300 mm/sec in the above setting example), sets the linear velocity S of the developing roller 83 (450 mm/sec) so that S/D has a predetermined first value (1.5) and further sets the linear velocity M of the magnetic roller 82 at a predetermined value (675 mm/sec) and controls the driver unit 962 (Step S4). Further, the bias controller 93 reads bias parameters set in advance for standard sized sheet development from the storage 94 and controls the first and second applying units 88, 89 based on the read bias parameters (Step S5). Thereafter, a printing process is performed for page image data of the standard sized sheet (Step S6).

On the other hand, if the sheet size discriminator 91 determines the "long sheet data" (YES in Step S3), the linear velocity controller 92 reads linear velocity parameters set in advance for long sheet development from the storage 942, sets the linear velocity D of the photoconductive drum 321 at a predetermined second velocity (150 mm/sec in the above setting example) slower than the first velocity, sets the linear velocity S of the developing roller 83 (300 mm/sec) so that S/D has a second value (2.0) larger than the first value and further sets the linear velocity M of the magnetic roller 82 at a speed reduction value (450 mm/sec) in proportion to the linear velocity S and controls the driver unit 96 (Step S7). Further, the bias controller 93 reads bias parameters set in advance for long sheet development from the storage 94 and controls the first and second applying units 88, 89 based on the read bias parameters (Step S8). Thereafter, a printing process is performed for page image data of the long sheet (Step S6).

Thereafter, the control unit 90 confirms whether or not page image data of the next page is stored in the image memory 963 (Step S9). If the image data of the next page is present (YES in Step S9), a return is made to Step S3 to repeat the process. If the image data of the next page is absent (NO in Step S9), the process is finished.

According to the image forming apparatus 1 of this embodiment as described above, the linear velocity D is set to be slower, the value of S/D is set to be larger and the linear velocity M is also set to be slower and the thickness of the toner layer TL carried on the developing roller 83 is set to be smaller in the transfer process to a long sheet than in the transfer process to a standard sized sheet in the image forming apparatus 1 capable of transferring a toner image to a long sheet. By executing such a control, the deterioration of toner particles can be suppressed even if the transfer process is performed on a long sheet. Therefore, the occurrence of image defects associated with the deterioration of toner particles can be prevented.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus, comprising:

an image bearing member for bearing an electrostatic latent image and a toner image;

a developer bearing member for bearing a developer layer containing toner particles and carrier particles while rotating in a predetermined direction;

a toner bearing member for receiving the toner particles from the developer layer and carrying a toner layer while rotating in contact with the developer layer and supplying the toner particles of the toner layer to the image bearing member to develop the electrostatic latent image;

a driving mechanism for driving and rotating the image bearing member, the developer bearing member and the toner bearing member;

a sheet size discriminator for discriminating whether a sheet to which the toner image is to be transferred is a standard sized sheet or a long sheet, the size of which in a sub scanning direction is longer than the standard sized sheet;

a first controller for controlling a linear velocity D of the image bearing member, a linear velocity M of the developer bearing member and a linear velocity S of the toner bearing member by controlling the driving mechanism; and a second controller for controlling the thickness of the toner layer carried on the toner bearing member; wherein:

the first controller sets the linear velocity D at a predetermined first velocity and sets the linear velocity S so that S/D, which is a ratio of the linear velocity S to the linear velocity D, has a predetermined first value and the second controller sets the thickness of the toner layer carried on the toner bearing member at a predetermined first layer thickness when the sheet size discriminator discriminates that the sheet to which the toner image is to be transferred is the standard sized sheet; and the first controller sets the linear velocity D at a second velocity slower than the predetermined first velocity and sets the linear velocity S so that the S/D has a second value larger than the predetermined first value and the second controller sets the thickness of the toner layer at a second layer thickness smaller than the predetermined first layer thickness when the sheet size discriminator discriminates that the sheet to which the toner image is to be transferred is the long sheet.

2. The image forming apparatus according to claim 1, further comprising a restricting member for restricting the layer thickness of the developer layer carried on the developer bearing member, wherein:

the first controller sets the linear velocity M at a predetermined third velocity at the time of a transfer process to the standard sized sheet and sets the linear velocity M at a fourth velocity slower than the predetermined third velocity at the time of a transfer process to the long sheet.

3. The image forming apparatus according to claim 2, wherein:

the first controller sets the linear velocity M and the linear velocity S so that M/S, which is a ratio of the linear velocity M to the linear velocity S, is substantially constant both at the time of the transfer process to the standard sized sheet and at the time of the transfer process to the long sheet.

4. The image forming apparatus according to claim 1, further comprising a bias applying unit for applying a bias to at least one of the developer bearing member and the toner bearing member to form a predetermined potential difference between the developer bearing member and the toner bearing member, wherein:

the second controller sets the bias such that the predetermined potential difference between the developer bearing member and the toner bearing member is a predetermined first potential difference at the time of the transfer process to the standard sized sheet and sets the bias such that the predetermined potential difference between the developer bearing member and the toner bearing member is a second potential difference smaller than the predetermined first potential difference at the time of the transfer process to the long sheet.

* * * * *